US007168589B2

(12) United States Patent
Dark

(10) Patent No.: US 7,168,589 B2
(45) Date of Patent: Jan. 30, 2007

(54) SPILL-RESISTANT CONTAINER

(76) Inventor: Richard C. G. Dark, 2248 Gum Tree La., Fallbrook, CA (US) 92028

( * ) Notice: Subject to any disclaimer, the term of this patent is extended or adjusted under 35 U.S.C. 154(b) by 288 days.

(21) Appl. No.: 10/936,013

(22) Filed: Sep. 8, 2004

(65) Prior Publication Data

US 2005/0230404 A1 Oct. 20, 2005

Related U.S. Application Data

(63) Continuation-in-part of application No. 10/824,869, filed on Apr. 15, 2004, now Pat. No. 7,100,790.

(51) Int. Cl.
*A79G 19/22* (2006.01)

(52) U.S. Cl. ..... 220/711; 222/482

(58) Field of Classification Search ..... 220/711, 220/713, 719, 703, 717, 726, 369, 361, DIG. 5; 215/310–315, 307, DIG. 7; 222/482, 489, 222/566, 571

See application file for complete search history.

(56) References Cited

U.S. PATENT DOCUMENTS

| | | | | |
|---|---|---|---|---|
| 3,360,161 | A | | 12/1967 | Smith |
| 3,730,399 | A | | 5/1973 | Dibrell et al. |
| 3,938,695 | A | | 2/1976 | Ruff |
| 4,130,215 | A | | 12/1978 | Corey et al. |
| 4,331,255 | A | | 5/1982 | Fournier |
| 5,065,880 | A | | 11/1991 | Horner |
| 5,249,703 | A | * | 10/1993 | Karp ..... 220/719 |
| 5,303,850 | A | * | 4/1994 | Connan ..... 222/153.07 |
| 5,540,350 | A | | 7/1996 | Lansky |
| 5,570,797 | A | * | 11/1996 | Yeh ..... 215/228 |
| 5,704,510 | A | * | 1/1998 | Feltman et al. ..... 220/293 |
| 5,979,689 | A | | 11/1999 | Lansky |
| 6,102,244 | A | * | 8/2000 | Kuwano et al. ..... 220/713 |
| 6,199,711 | B1 | | 3/2001 | Lanskey |
| 6,305,571 | B1 | | 10/2001 | Chu |
| 6,488,170 | B1 | | 12/2002 | Johnson |
| 6,523,712 | B1 | | 2/2003 | McGushion |
| 6,640,992 | B1 | | 11/2003 | Berger et al. |
| 6,659,302 | B2 | | 12/2003 | Lin |
| 2002/0003145 | A1 | | 1/2002 | Milan |

* cited by examiner

*Primary Examiner*—Lien M. Ngo
(74) *Attorney, Agent, or Firm*—Eric Karich

(57) ABSTRACT

A spill-resistant container is disclosed including a cup and a cap. The cup includes a cap-engaging portion adjacent a lip surrounding an opening, and an inwardly projecting ledge adjacent the cap-engaging portion that includes multiple spaced apart recesses. The cap includes a cup-engaging portion and a cover portion. The cap has multiple spaced apart openings extending through the cover portion, wherein each of the openings corresponds to a different one of the recesses in the ledge of the cup.

11 Claims, 7 Drawing Sheets

SPILL-RESISTANT CONTAINER

CROSS-REFERENCE TO RELATED APPLICATIONS

This application for a utility patent is a continuation-in-part of a previously filed utility patent having the application Ser. No. 10/824,869, filed Apr. 15, 2004, now U.S. Pat. No. 7,100,790. This application is incorporated herein by reference in its entirety.

BACKGROUND OF THE INVENTION

1. Field of the Invention

This invention relates generally to liquid beverage containers, and more particularly to liquid beverage containers that are spill-resistant and capable of dispensing a liquid at a controlled rate.

2. Description of Related Art

Caps or lids are commonly placed over openings of cups containing liquid beverages to form closed containers, especially prior to transport. Spill-resistant caps are also known that prevent spilling of the liquid beverage while allowing the liquid beverage be consumed. Avoiding such spilling is especially important when the beverage is a hot liquid such as coffee or tea.

Re-usable cups with spill-resistant caps intended for use by young children are typically called "training cups." Many training cups have spouts and handles. It has been found that children drinking from training cups with spouts may develop deformed palettes that create speech problems. In addition, children using training cups with handles must learn to use handles, and often throw the training cups down when frustrated during this learning process.

Examples of spill-resistant caps include the following:

Dibrell et al., U.S. Pat. No. 3,730,399, describes a non-spill cap that has two layers, an outer cover section that is secured to the cup, and an inner closure section that is attached to the outer cover section. The outer cover section has a plurality of apertures through its body, and the inner closure section flexes between a sealed configuration, in which the inner closure section seals the apertures of the outer cover section, and an open configuration, in which the inner closure section allows fluid flow through the apertures.

M. B. Smith, U.S. Pat. No. 3,360,161, describes a splash-proof drinking vessel that includes a two layer cap for regulating fluid flow. Each layer of the two layer cap includes apertures to enable fluid flow through the cap. In one embodiment, the two layers are separated, and fluid flow is always possible, although somewhat restricted by the two layers. In other embodiments, the two layers can be rotated with respect to each other, so that in an open position, the apertures are aligned and fluid flow is possible, and in other embodiments the apertures are not aligned, and fluid flow is not possible.

Milan, U.S. 2002/0003145 A1, describes a removable beverage container lid for a beverage container. The lid has a substantially enclosed space defined between an exterior cover and an interior cover. At least one inlet opening is formed with the interior cover through which a hot beverage is to flow into the substantially enclosed space. Attached to the interior cover at the forward edge of the inlet opening is a partition or wall assembly with the height of the partition or wall assembly extending to be located substantially against the exterior cover. The length of the partition or wall assembly is at least equal to the length of the inlet opening.

Between the partition or wall assembly and the peripheral edge of the exterior cover is located a gap area. Connected with the gap area is a dispensing opening formed within the exterior cover. Hot beverage is required to flow around the partition or wall assembly and into the gap area prior to flowing through the dispensing opening exteriorly of the beverage container. The wall assembly connects with raised areas on the exterior cover each of which has a groove to permit a small amount of the beverage to flow directly into the gap area.

McGushion, U.S. Pat. No. 6,523,712 B1, describes a spill-resistant lid that includes a mounting portion for gripping the upper rim of the container, a sidewall extending upwardly from the mounting portion, and a top wall having a fluid consumption aperture formed therethrough. A spout descends from the fluid consumption aperture towards the interior of the container to which the lid is mounted. The fluid contained within the container must travel through the spout before exiting the fluid consumption aperture. The geometry of the spout is generally either tubular or hollow frusta-conical. One or more steam venting apertures may be formed through the top wall.

Corey et al., U.S. Pat. No. 4,130,215, describes a spill-resistant cup that includes at least two baffle members positioned within the cup wall. Each baffle is generally annular having a central opening and each baffle contains a plurality of passageways (holes or elongated slots) passing therethrough.

Fournier, U.S. Pat. No. 4,331,255, describes a spill-resistant container cover that includes of a pair of similarly dimensioned discoid sections connected with a flexible hinge. The two sections are oriented so that the second section can be flipped over onto the first so that a peripheral channel on the second section engages over a peripheral channel on the first section to provide a shallow space between the two sections bounded by peripheral seal. An array of small openings are provided in the first section leaving a relatively large contiguous imperforate area in that section. A removable tab is provided for forming a drinking opening in the second section, the tab being positioned so that it is disposed opposite the imperforate area in the first section.

Chu, U.S. Pat. No. 6,305,571 B1, describes a spill-resistant lid device for dispensing fluid contained in a drinking container. A mounting portion is configured to sealingly engage a lip portion of a container. A top cover is coupled to the mounting portion and extends substantially laterally across the container opening when the mounting portion is sealingly engaged with the container lip. The top cover includes a top wall and a bottom wall cooperating to define an interior cavity. The top wall has a drinking port in flow communication with the interior cavity. The bottom wall defines a baffle opening which extends into the interior cavity and is adapted to reduce splashing of fluid through the opening fluid dispensed from the container must pass through the baffle opening and into the interior cavity before passing through the drinking port.

Ruff, U.S. Pat. No. 3,938,695, describes a spill-resistant lid that includes a plurality of apertures to minimize accidental spilling of any liquid in the container, even if the container is jogged, shaken, or moved unevenly so as to cause spillage of its contents when a slosh wave overrides the rim of the container.

Lansky, U.S. Pat. No. 5,540,350, describes a guard for preventing splashing from a drinking container. The guard includes a lower disk having an outer circular rim for engaging the inner face of the sidewall of the drinking container, an upper disk having an outer rim spaced from the drinking container to provide an annular passage between the upper disk and the inner face of the sidewall of the drinking container with which the guard is used, a baffle interposed between the lower disk and the upper disk for functioning to baffle the beverage when the drinking container is in motion and to act as a support for supporting the upper disk from the lower disk, and a passageway is provided through the lower disk to allow passage of the beverage through the lower disk to a position above the lower disk. An upstanding handle is provided on the upper disk and a receptacle is provided on the lower disk to removably receive the handle and permit stacking of the guards.

It would be advantageous to have a cap and/or container that doesn't have a spout, is spill-resistant, and dispenses liquid at a controlled rate.

SUMMARY OF THE INVENTION

The present invention provides a spill-resistant container that includes a cup and a cap. The cup includes a cap-engaging portion adjacent a lip surrounding an opening, and has an inwardly projecting ledge adjacent the cap-engaging portion. The inwardly projecting ledge has multiple spaced apart recesses. The cap includes a cup-engaging portion and a cover portion. The cap has multiple spaced apart openings extending through the cover portion, wherein each of the openings corresponds to a different one of the recesses in the ledge of the cup.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
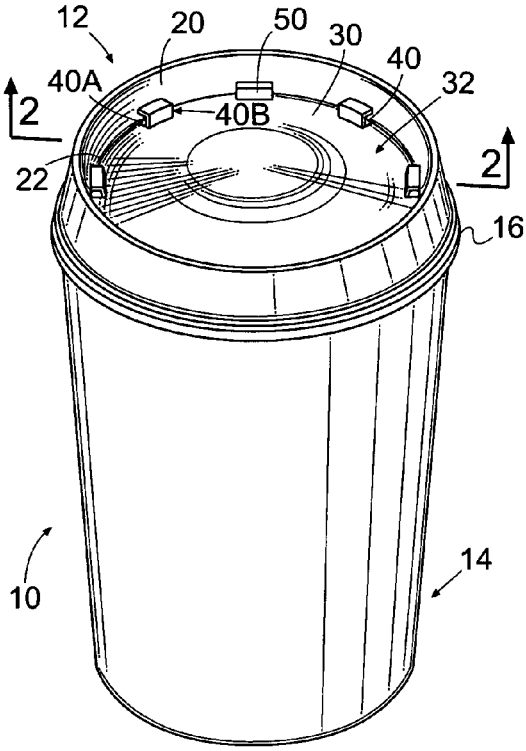
FIG. 1 is a perspective view of one embodiment of a drinking container including a cup and a spill-resistant cap.
Figure 2:
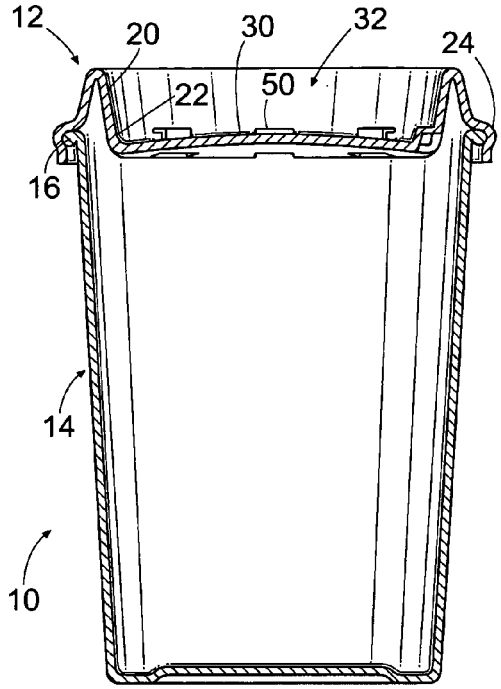
FIG. 2 is a cross-section view thereof taken along line 2—2 in FIG. 1.
Figure 3:
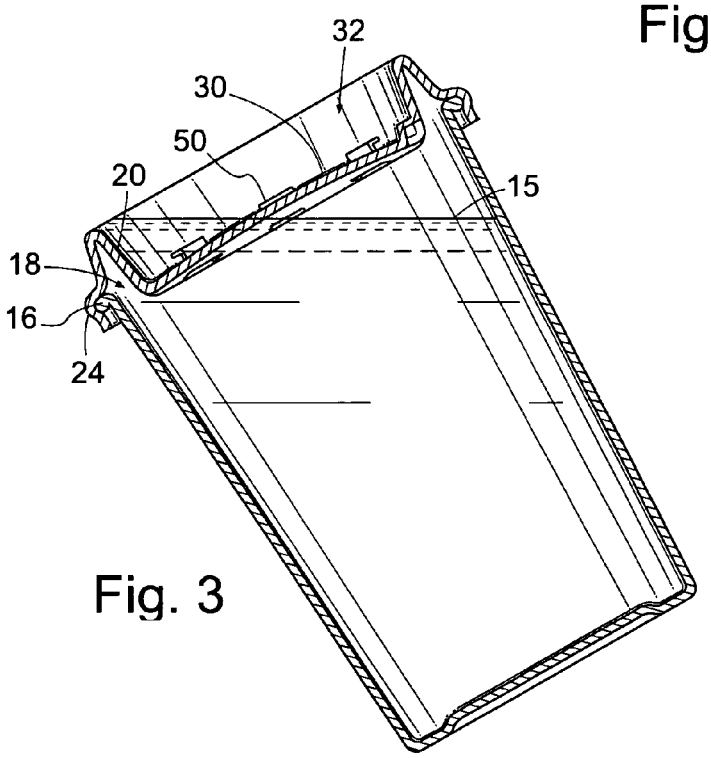
FIG. 3 is the cross-section view of FIG. 2, illustrating how a fluid is dispensed from the drinking container.

FIG. 1 is a perspective view of one embodiment of a drinking container 10 including a spill-resistant cap 12 and a cup 14. As shown in FIGS. 1–3, the cup 14 is provided for holding a liquid (such as a liquid beverage, shown as reference number 15 in FIG. 3), and has a lip 16 that forms an opening 18. The cap 12 is adapted for attaching to the cup 14 adjacent the lip 16 for covering the opening 18. While we show two specific embodiments of the cup, the term cup is hereby defined to include any form of cup, glass, bottle, jar, jug, or other container that is suitable for use with the cap 12 described herein, for the purpose of dispensing a liquid 15. The term cup should not be construed to be limited to any one particular embodiment or use.

As shown in FIGS. 1–3, the cap 12 includes a cup-engaging portion 24 and a cover portion 30. The cap 12 has a plurality of spaced apart openings 40 extending through the cover portion 30. In the present embodiment, the cap 12 includes an annular sidewall 20, the cover portion 30 is a center portion, and the plurality of spaced apart openings 40 are partially covered with a plurality of baffles 50. The cup-engaging portion 24 of this embodiment includes a lip engaging portion of the annular sidewall 20. The annular sidewall 20 also includes a lower end 22. The lip engaging portion 24 is adapted to engage the lip 16 of the cup 14. In embodiment of FIGS. 1–3, the lip engaging portion 24 is provided by a generally C-shaped portion that is adapted to frictionally engage the lip 16. Other embodiments of the lip engaging portion 24 are described below.

While we describe the sidewall as "annular", this is not meant to limit the structure to a circular shape, but to any functionally similar shape that will mate with the lip 16 of the cup 14. Furthermore, for purposes of this application, the term "plurality" means more than one, and include as few as two, even though more than two may be illustrated.

As shown in FIGS. 1–3, the center portion 30 functions to close the lower end 22 of the annular sidewall 20 to cover the opening, such that the annular sidewall 20 and the center portion 30 together form an upper reservoir 32. The plurality of spaced apart openings 40 extend through the upper reservoir 32, for the controlled dispensing of liquid 15, as described below. The center portion 30 is preferably sloped towards the plurality of spaced apart openings 40, to facilitate the flow of fluid from the upper reservoir 32, through the plurality of spaced apart openings 40, and back into the cup 14, as described in greater detail below.

As shown in FIGS. 1–3, the plurality of baffles 50 are disposed to prevent splashing of the fluid 15 through the plurality of spaced apart openings 40. In the preferred embodiment, each of the plurality of baffles 50 is formed over one of the plurality of spaced apart openings 40. Each of the plurality of baffles 50 is preferably an curving, arching, or otherwise extending sidewall that is spaced from and spans over one of the plurality of spaced apart openings 40 to form a pair of side apertures 40A and 40B on either side of the opening 40. For example, each of the plurality of baffles 50 may span one of the plurality of spaced apart openings 40 from the annular sidewall 20 to the center portion 30, thereby forming the pair of side apertures 40A and 40B on either side of each baffle 50.

In alternative embodiments, the plurality of baffles 50 could also have other shapes and configurations. For example, the plurality of baffles 50 could each extend only from the center portion 30, or the annular sidewall 20. The plurality of baffles 50 could also integrally formed in the shape of each of the plurality of spaced apart openings 40. Such alternatives should be considered within the scope of the present invention, as claimed below.

In use, the drinking container 10 is useful for dispensing the liquid 15 at a controlled rate, without splashing, and is therefore particularly well suited to use by babies or small children, or by adults using drinks such as coffee that can be particularly damaging if spilled.

As shown in FIG. 3, during ordinary use, the drinking container 10 is tilted so that the liquid 15 flows steadily through the plurality of spaced apart openings 40, past the plurality of baffles 50, to slowly fill the upper reservoir 32. The user is able to drink from the upper reservoir 32. Due to the nature of the upper reservoir 32, the user is able to drink from the drinking container 10 from any portion of the cap 12, without having to turn the drinking container 10 to any one particular orientation.

When the user returns the drinking container 10 to an upright position, the liquid 15 flows back down the plurality of spaced apart openings 40 and into the cup 14. The slope of the center portion 30 facilitates the flow of the liquid 15 back into the cup 14.

If the drinking container 10 is turned upside down, so that all of the plurality of spaced apart openings 40 are covered, a vacuum is formed in the cup 14 that advantageously substantially prevents the liquid 15 from exiting the cup 14, preventing a spill. If the drinking container 10 containing a liquid 15 is jarred, the liquid 15 that escapes through the plurality of spaced apart openings 40 is deflected by the plurality of baffles 50 either into the cup 14 or into the upper reservoir 32, from which it drains back into the cup 14.

It is noted that the number and sizes of the plurality of spaced apart openings 40 in the cap 12 are largely determined by a desired flow rate of the liquid 15 from the cup 14 into the upper reservoir 32 when the drinking container 10 is tilted to one side, as shown in FIG. 3. In one embodiment the cap 12 of the drinking container 10 has eight (8) openings 40 (or pairs of side apertures 40A and 40B); however, a wide variety of sizes and numbers could be used. In the preferred embodiment, the drinking container 10 has 6–10 openings 40; and in the most preferred embodiment, the drinking container 10 has 8 openings.

The cap 12 may be made of a rigid material such as plastic, or any other suitable material. The cup 14 may also be made of a molded plastic, or in the alternative, out of paper/cardboard or any other material from which such cups are generally constructed. In the embodiment of FIGS. 1–3, the cap 12 is constructed of a vacuum formed plastic and the cup 14 is constructed of paper or cardboard, and is similar to prior art disposable drinking containers that are used to drink coffee. In this embodiment, the cap 12 is frictionally engaged to the cup 14, as described above.

Figure 4:
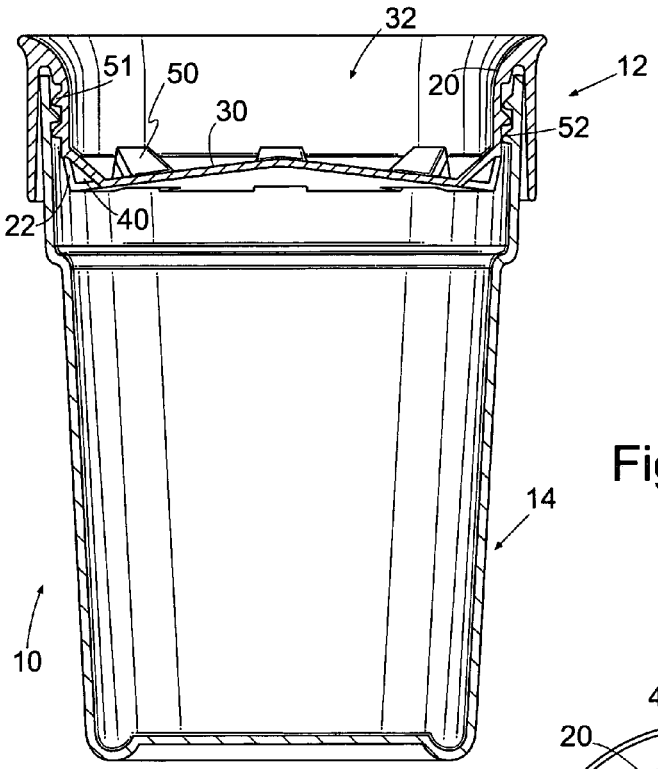
FIG. 4 is cross-section view of another embodiment of the drinking container.
Figure 5:
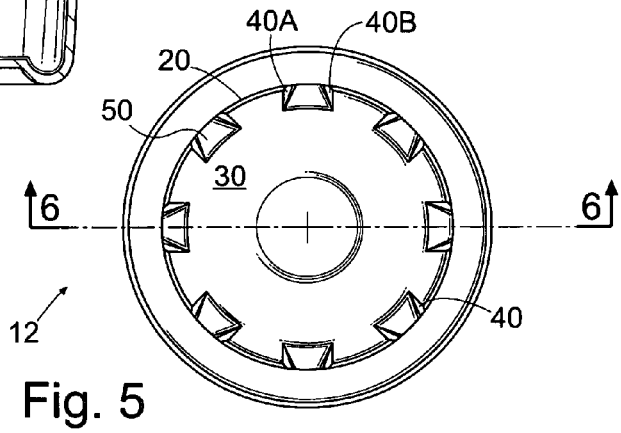
FIG. 5 is a top plan view of the spill-resistant cap of FIG. 4.
Figure 6:
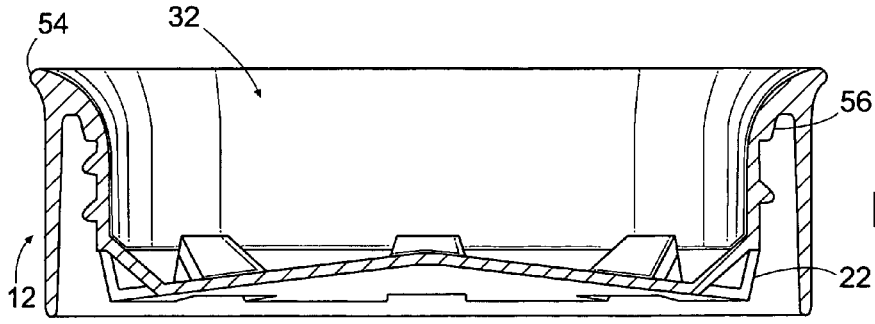
FIG. 6 is a cross-section view thereof taken along line 6—6 in FIG. 5.

In an alternative embodiment, as shown in FIGS. 4–6, the drinking container 10 is a baby training cup. In this embodiment, the lip engaging portion includes an threaded portion 51 on the exterior surface of the annular sidewall 20. The threaded portion 51 is adapted to threadedly engage an internal thread 52 of the cup 14. If course, this terminology should be construed to include the opposite configuration; however, it is preferred that the thread 52 be on the inside of the cup 14 so that the cup 14 can be used without the cap 12, without the thread 52 interfering with the baby's lips during use. In this embodiment, the threaded nature of the connection is preferred because babies routinely drop their cups, and an especially strong connection between the cap 12 and the cup 14 is desired.

As shown in FIG. 6, the cap 12 in this embodiment includes an outer rim 54 that is shaped to extend outwardly to facilitate use of the drinking container 10 by a baby. The annular sidewall 20 further includes a sealing surface 56 that is adapted to sealingly engage the cup 14 to prevent leakage.

In this embodiment, both the cap 12 and the cup 14 are constructed of molded plastic using techniques known in the art. Those skilled in the art will recognize, however, that alternative materials could also be used, and the description of the current preferred embodiments should not be construed to limited the scope of the invention to any one particular material. Rather, the scope of the invention should be considered only in reference to the claims, and should include alternative structures, materials, and elements that would be known to one skilled in the art.

Furthermore, while only two specific uses have been described, those skilled in the art will recognize that the inventive concept could also be applied to a wide variety of alternative uses and embodiments, and such alternatives should be considered within the scope of the claimed invention.

Figure 7:
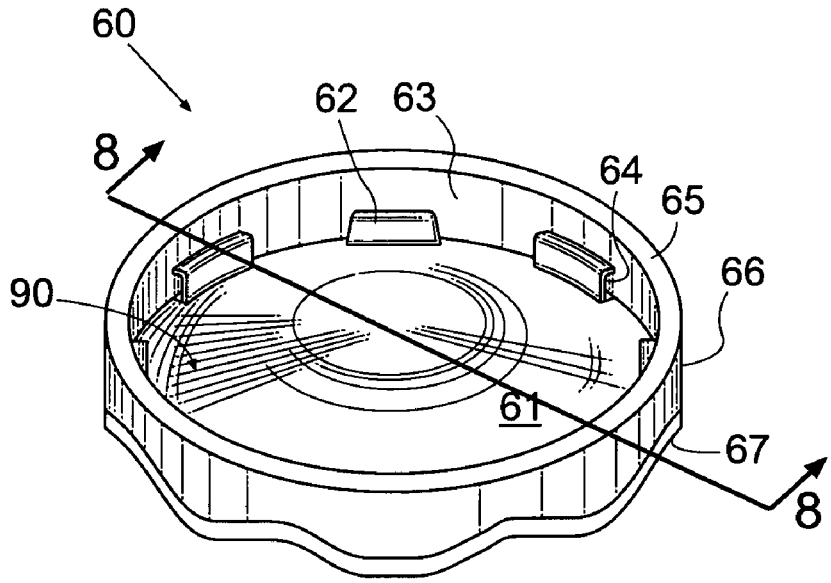
FIG. 7 is a perspective view of a cap of one embodiment of a spill-resistant container.

FIGS. 7–13 will now be used to describe one embodiment of a spill-resistant container including a cup and a mating cap. FIG. 7 is a perspective view of the cap, labeled 60, of the spill-resistant container. The cap 60 is similar to the cap 12 of FIGS. 1–6, and includes a circular cover portion 61 and an annular sidewall 63 extending upward from an outer perimeter of the cover portion 61. The cover portion 61 and the annular sidewall 63 in combination form a reservoir 90 of the cap 60. The cap 60 has multiple spaced apart openings 64 positioned at an interface between the cover portion 61 and the annular sidewall 63 and extending through the reservoir 90. As described below, each of the openings 64 correspond to a different one of multiple recesses in an inwardly projecting ledge of the cup. Each of the openings 64 is covered by a corresponding baffle 62. The cap 60 has a lip 65 and a skirt 66 extending downward from the lip 65. In the embodiment of FIG. 7 the skirt 66 has a wavy bottom edge 67 wherein downward extending portions of waves in the wavy bottom edge 67 correspond to positions of the spaced apart openings 64 and the baffles 62.

Figure 8:
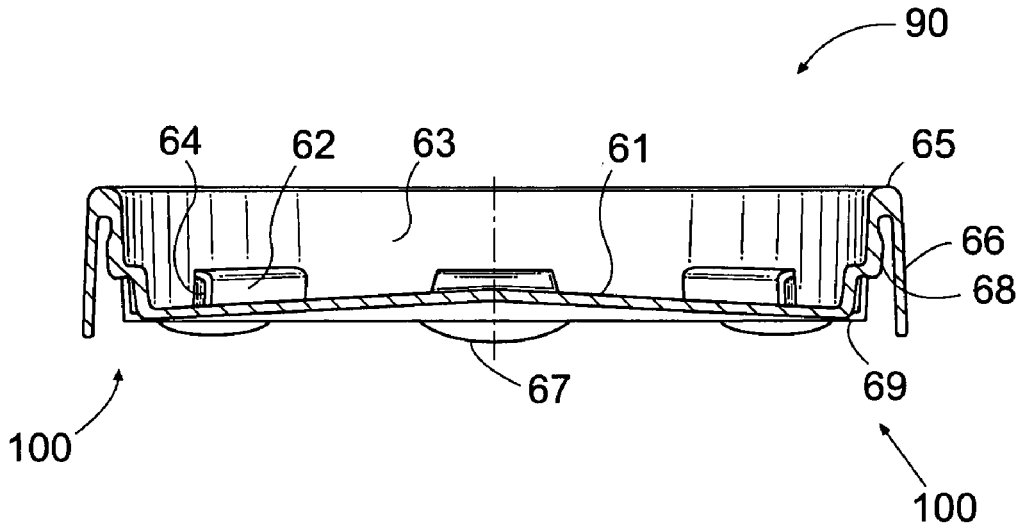
FIG. 8 is a sectional view of the cap of FIG. 7 as indicated in FIG. 7.

FIG. 8 is a sectional view of the cap 60 of FIG. 7 as indicated in FIG. 7. FIG. 8 shows a cup-engaging portion 100 of the cap 60, wherein the cup-engaging portion 100 includes a ridge 68 protruding outwardly from a surface opposite the annular sidewall 63. The ridge 68 corresponds to a groove in a cap-engaging portion of the cup of the spill-resistant container. When the cap 60 is attached to the cup, the ridge extends into the groove of the cup, serving to hold the cap 60 securely on the cup and forming a liquid-tight seal between the cap 60 and the cup.

In FIG. 8 outer sections of a bottom surface of the circular center portion 61 extending between the openings 64 form sealing surfaces 69. When the cap 60 is attached to the cup and the container is in a closed position, the sealing surfaces 69 contact similar sealing surfaces of the cup.

Figure 9:
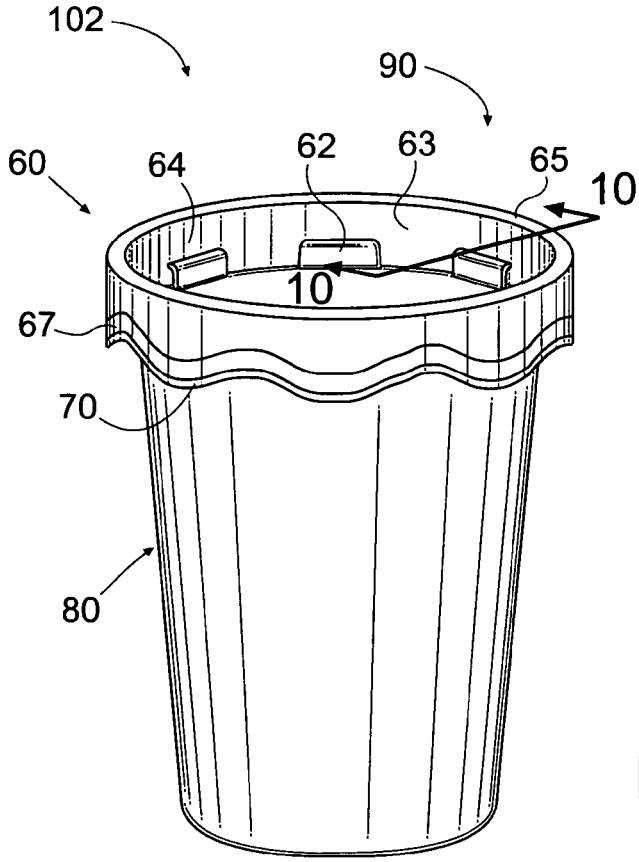
FIG. 9 is a perspective view of the spill-resistant container wherein the cap of FIGS. 7 and 8 is attached to a cup of the spill-resistant container.

FIG. 9 is a perspective view of the spill-resistant container, labeled 102, wherein the cap 60 is attached to the cup, labeled 80. In the embodiment of FIG. 9 the cup 80 has a wavy bulge 70 adjacent a lip. As described above the cup has an inwardly projecting ledge with multiple spaced apart recesses. Downward extending portions of waves of the wavy bulge 70 correspond to positions of the spaced apart recesses in the inwardly projecting ledge. In FIG. 9 the waves of the wavy bottom edge 67 of the cap 60 are aligned with the waves of the wavy bulge 70 of the cup 80. Accordingly, the spaced apart openings 64 of the cap 60 are aligned with the spaced apart recesses in the inwardly projecting ledge of the cup 80. The container 102 is in an open position wherein when the cup is tilted, a liquid stored in a chamber of the cup 80 may flow into the reservoir 90 of the cap 60 via the aligned recesses and openings 64.

Figure 10:
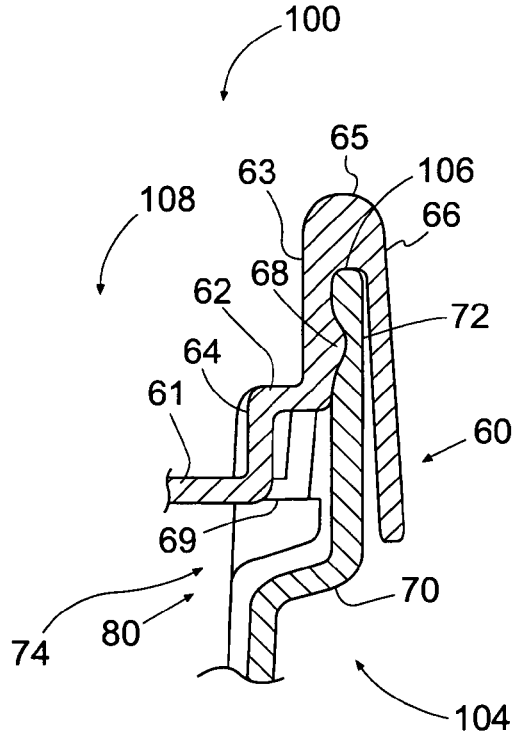
FIG. 10 is a cross-section view thereof taken along line 10—10 in FIG. 9.

FIG. 10 is a sectional view of a portion of the spill-resistant container 102 of FIG. 9 as indicated in FIG. 9. One of the multiple recesses in the inwardly projecting ledge of the cup 80 is shown in FIG. 10 and labeled 74. In FIG. 10 the recess 74 is aligned with a corresponding one of the spaced apart openings 64 of the cap 60. When the cup 80 is tilted, liquid stored in a chamber of the cup 80 may flow into the reservoir 90 of the cap 60 via the recess 74 and the aligned corresponding opening 64.

FIG. 10 also shows a cap-engaging portion 104 of the cup 80, wherein the cap-engaging portion 104 includes the groove described above and labeled 72. The groove 72 is adjacent the lip of the cup 80, labeled 106, wherein the lip 106 surrounds an opening 108 of the cup 80. In FIG. 10 the ridge 68 of the cup-engaging portion 100 of the cap 60 resides in the groove 72 of the cap-engaging portion 104 of the cup 80, and the cap 60 is attached to the cup 80 and securely held in place.

In FIG. 10 the cup-engaging portion 100 of the cap 60 rotatably engages the cap-engaging portion 104 of the cup 80 such that the cup 80 and the cap 60 can be rotated relative to one another between closed and open positions of the spill-resistant container 102. Further, the liquid-tight seal described above is also formed between the cap 60 and the cup 80.

Figure 11:
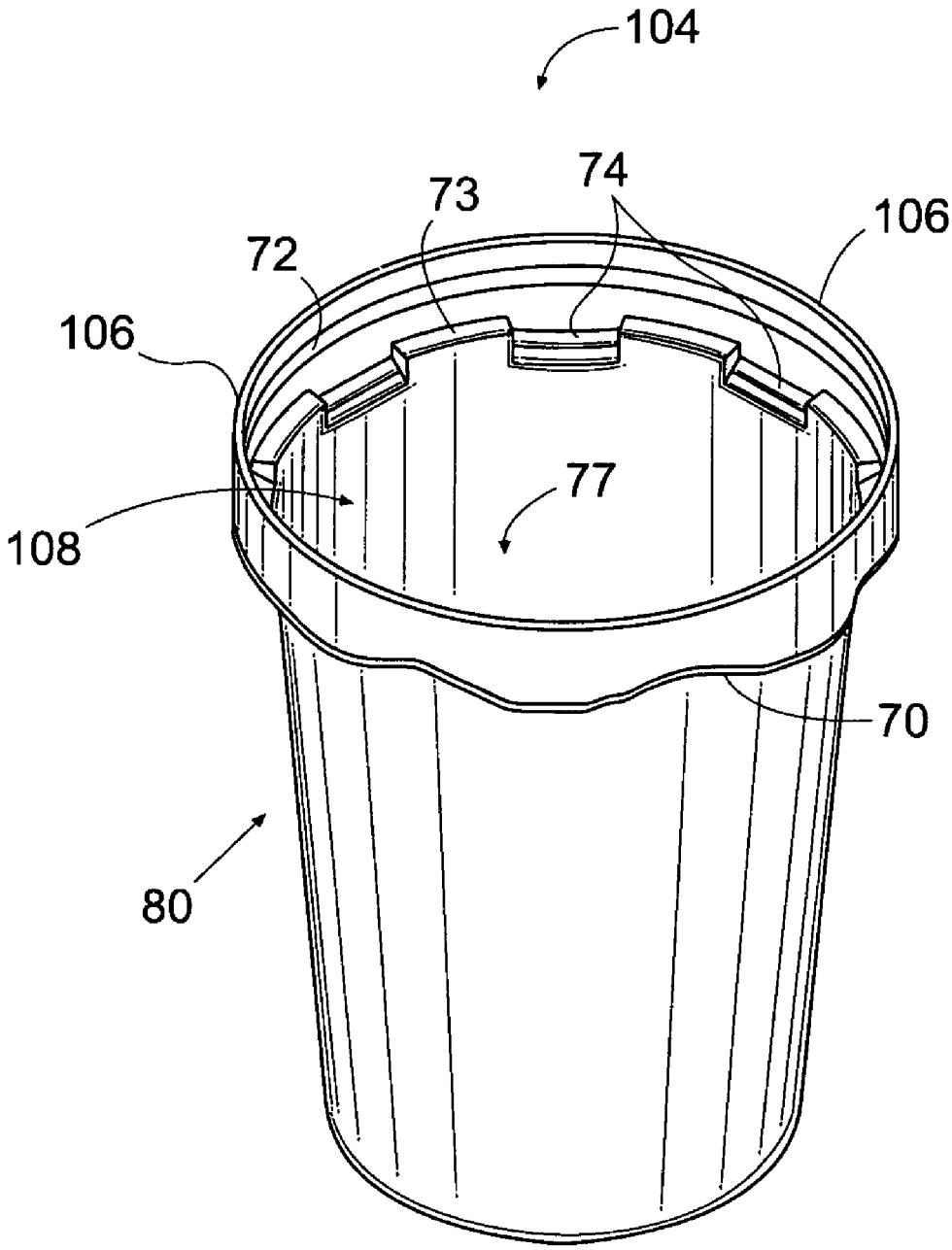
FIG. 11 is a perspective view of the cup of FIG. 9.

FIG. 11 is a perspective view of the cup 80 of FIG. 9. The cup 80 includes the cap-engaging portion 104 adjacent the lip 106 surrounding the opening 108, and the chamber of the cup 80 is labeled 77. The inwardly projecting ledge is labeled 73, and is adjacent the cap-engaging portion 104 as shown in FIG. 11. The inwardly projecting ledge 73 has the multiple spaced apart recesses 74. Each of the recesses 74 correspond to a different one of the openings 64 of the cap 60 (see FIGS. 7–10).

Figure 12:
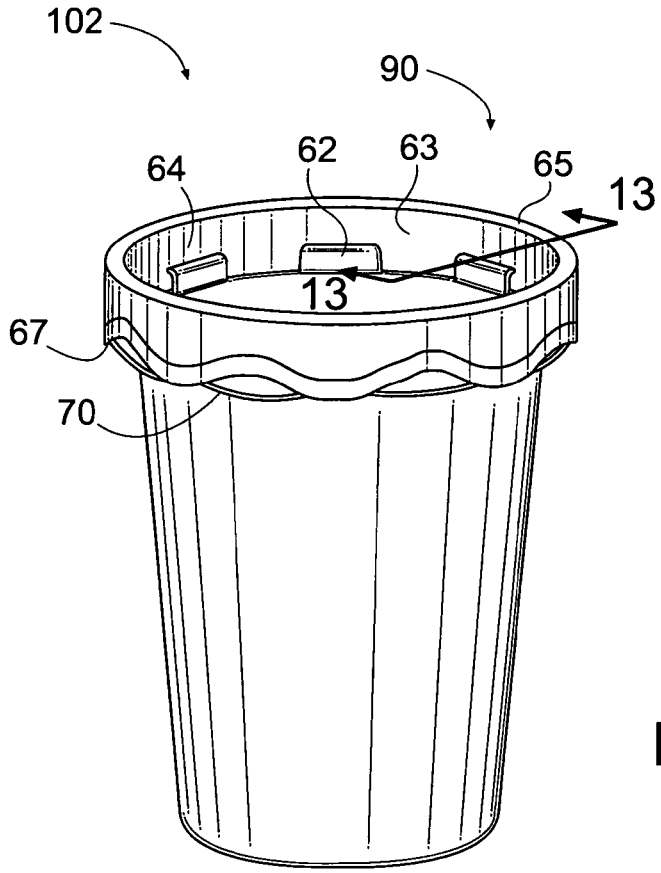
FIG. 12 is a perspective view of the spill-resistant container of FIG. 9 wherein the container is in a closed position.

FIG. 12 is a perspective view of the spill-resistant container 102 wherein the container 102 is in the closed position. In FIG. 12 the waves of the wavy bottom edge 67 of the cap 60 are not aligned with the waves of the wavy bulge 70 of the cup 80. More specifically, downward extending portions of the waves of the wavy bottom edge 67 of the cap 60 are midway between downward extending portions of the waves of the wavy bulge 70 of the cup 80. Accordingly, the spaced apart openings 64 of the cap 60 are not aligned with the spaced apart recesses 74 in the inwardly projecting ledge 73. When the cup 80 is tilted, the liquid stored in the chamber 77 of the cup 80 is prevented from flowing into the reservoir 90 of the cap 60.

Figure 13:
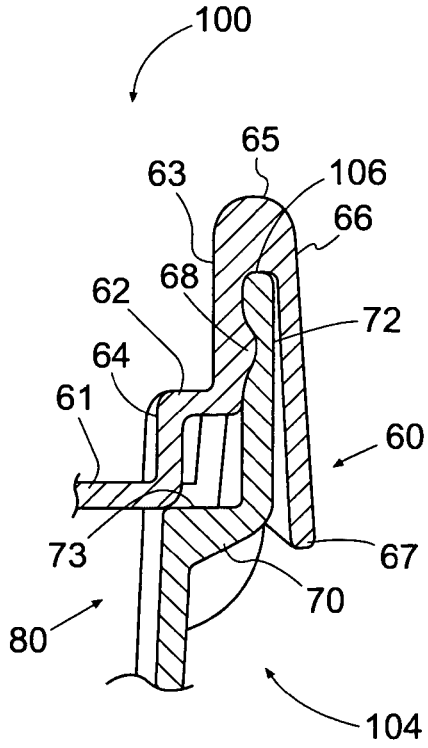
FIG. 13 is a cross-section view thereof taken along line 13—13 in FIG. 12.

FIG. 13 is a sectional view of a portion of the container 102 illustrating upper surfaces of the portions of the inwardly projecting ledge 73 extending between the spaced apart recesses 74 form sealing surfaces. When the cap 60 is attached to the cup 80 and the container 102 is in the closed position as shown in FIG. 13, the sealing surfaces of the cup 80 contact the sealing surfaces 69 of the cap 60, and the liquid stored in the chamber 77 of the cup 80 is prevented from flowing into the reservoir 90 of the cap 60.

A partially open condition exists when the waves of the wavy bottom edge 67 of the cap 60 are not aligned with the waves of the wavy bulge 70 of the cup 80, and the downward extending portions of the waves of the wavy bottom edge 67 of the cap 60 are not midway between downward extending portions of the waves of the wavy bulge 70 of the cup 80. The resulting restriction produces a lower flow rate that may be desirable in certain situations.

While the use of wavy surfaces for indicating alignment between the spaced apart openings 64 of the cap 60 and the spaced apart recesses 74 in the inwardly projecting ledge 73 of the cup 80 have been described, it is noted that other means for indicating alignment are possible and contemplated. For example, the bottom edge 67 of the skirt 66 of the cap 60 may have structures other than waves for indicating positions of the spaced apart openings 64, and the bulge 70 of the cup 80 adjacent the lip 106 may include structures other than waves for indicating positions of the spaced apart recesses 74 in the inwardly projecting ledge 73. When the structures of the bottom edge 67 of the skirt 66 of the cap 60 are aligned with the structures of the bulge 70 of the cup 80 adjacent to the lip 106, the spaced apart openings 64 of the cap 60 may be aligned with the spaced apart recesses 74 in the inwardly projecting ledge 73 of the ledge 73 of the cup 80 such that the spill-resistant container 102 is in the open position.

Figure 14:
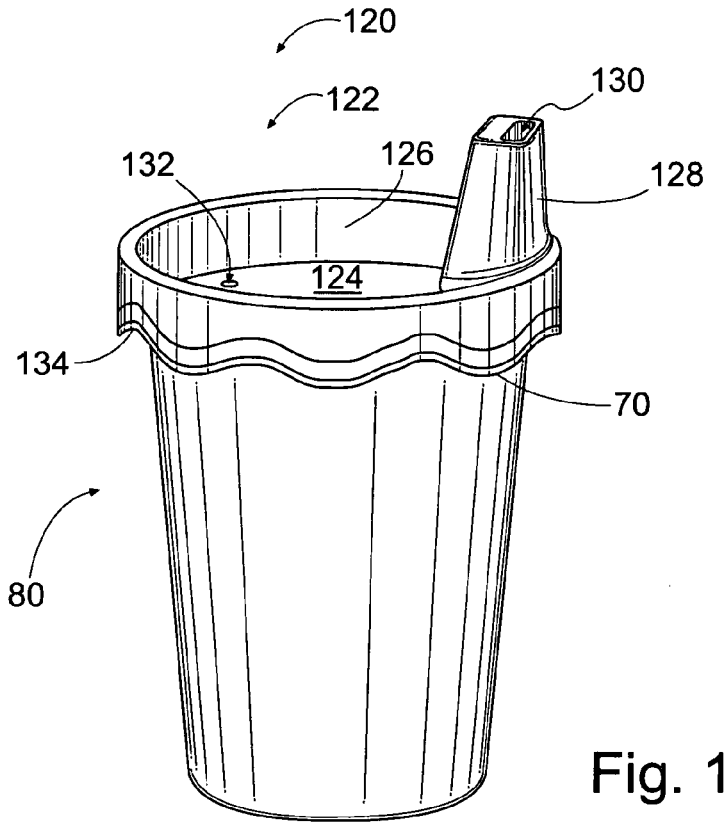
FIG. 14 is a perspective view of another embodiment of the spill-resistant container.
Figure 15:
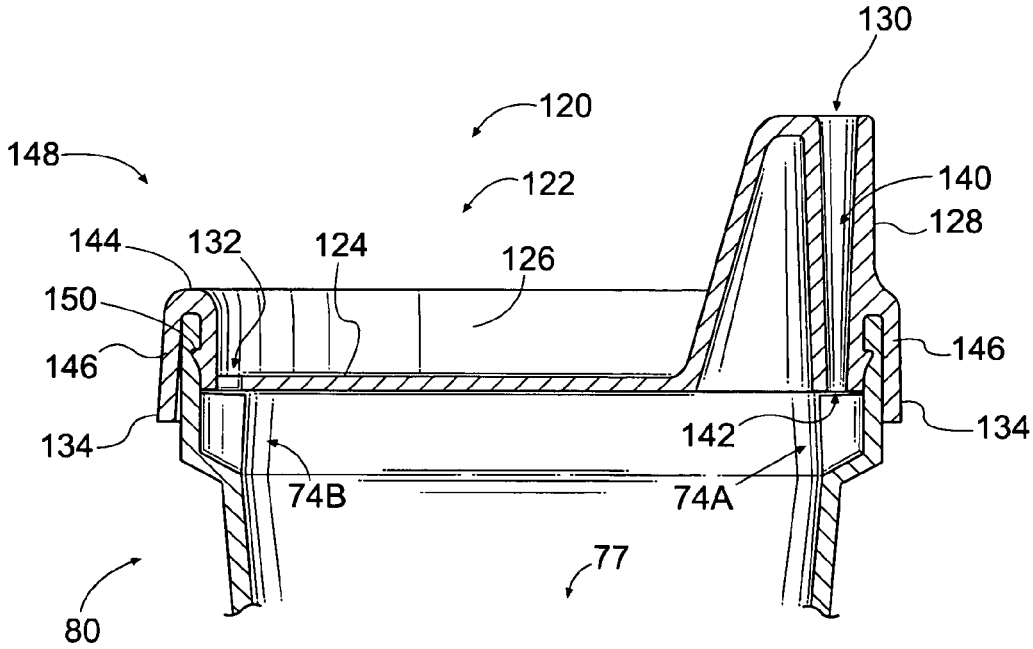
FIG. 15 is a sectional view of the spill-resistant container of FIG. 14.

FIGS. 14 and 15 will now be used to describe another embodiment of the spill-resistant container. FIG. 14 is a perspective view of the other embodiment of the spill-resistant container, labeled 120, wherein a cap 122 is attached to the cup 80 of FIGS. 9–13. In this embodiment, the cap 122 includes a cover portion 124 and an annular sidewall 126 extending upward from an outer perimeter of the cover portion 124. A spout 128 extends upward from the cover portion 124 adjacent the sidewall 126 at one side of the cap 122. The spout 128 has an orifice 130 in an upper portion that forms an opening at an end of a duct extending through the spout 128. A vent opening 132 extends through the cover portion 124 at a side of the cap 122 opposite the spout 128. The vent opening is adjacent the sidewall 126.

The cap 122 may include a wavy bottom edge 134 (or otherwise marked, styled, shaped, or colored) similar to the wavy bottom edge 67 shown in FIGS. 7–9 and 12 and described above. In FIG. 14 waves of the wavy bottom edge 134 are aligned with the waves of the wavy bulge 70 of the cup 80. In this orientation, the duct extending through the spout 128 is aligned with one of the spaced apart recesses 74 in the inwardly projecting ledge 73 of the cup 80. (See FIG. 11.) The container 120 is in an open position wherein when the container 120 is tilted, a liquid stored the chamber 77 of the cup 80 may flow into the duct of the spout 128 and out the orifice 130 in the upper portion of the spout 128.

In the open position of FIG. 14, the vent opening 132 is aligned with another one of the spaced apart recesses 74 in the inwardly projecting ledge 73 of the cup 80. (See FIG. 11.) As the liquid stored in the chamber 77 of the cup 80 exits via the duct of the spout 128, air may flow into the chamber 77 via the vent opening 132, thereby preventing a flow-inhibiting vacuum condition within the container 120.

FIG. 15 is a sectional view of the spill-resistant container 120 of FIG. 14. In FIG. 15 the duct of the spout 128 is labeled 140, and the opening at end of the duct 140 opposite the orifice 130 is labeled 142. The container 120 is in the open position, and the opening 142 at the end of the duct 140 is aligned with one of the spaced apart recesses 74, labeled 74A, in the inwardly projecting ledge 73 of the cup 80. (See FIG. 11.)

In the embodiment of FIG. 15, the cap 122 has a lip 144 and a skirt 146 extending downward from the lip 144. The skirt 146 includes the wavy bottom edge 134. Downward extending portions of waves in the wavy bottom edge 134 correspond to positions of the spout 128 and the vent opening 132. A cup-engaging portion 148 of the cap 122 includes a ridge 150 protruding outwardly from a surface opposite the annular sidewall 126. The ridge 150 corresponds to the groove 72 in the cap-engaging portion 104 of the cup 80. (See FIG. 10.) In FIGS. 14 and 15 the cap 122 is attached to the cup 80. The ridge 150 of the cap 122 extends into the groove 72 of the cup 80, serving to hold the cap 122 securely on the cup 80 and forming a liquid-tight seal between the cap 122 and the cup 80.

When the container 120 is tilted, the liquid stored the chamber 77 of the cup 80 may flow into the duct 140 of the spout 128 and out the orifice 130 in the upper portion of the spout 128. The vent opening 132 is aligned with another one of the spaced apart recesses 74, labeled 74B. As the liquid stored in the chamber 77 of the cup 80 exits via the duct of the spout 128, air may flow into the chamber 77 via the vent opening 132, thereby preventing a flow-inhibiting vacuum condition within the container 120.

Like the spill-resistant container 102 of FIGS. 7–13, the spill-resistant container 120 of FIGS. 14–15 also has a closed position. In the closed position the waves of the wavy bottom edge 134 of the cap 122 are not aligned with the waves of the wavy bulge 70 of the cup 80. In the closed position, the opening 142 at the end of the duct 140 and the vent opening 132 are not aligned with the spaced apart recesses 74 of the inwardly projecting ledge 73 of the cup 80. In the closed position, when the cup 80 is tilted, the liquid stored in the chamber 77 of the cup 80 is prevented from flowing into the duct 140 of the spout 128 of the cap 122. The cup-engaging portion 148 of the cap 122 rotatably engages the cap-engaging portion 104 of the cup 80 such that the cup 122 and the cap 80 can be rotated relative to one another between the closed and open positions.

While the invention has been described with reference to two preferred embodiments, it is to be clearly understood by those skilled in the art that the invention is not limited thereto. Rather, the scope of the invention is to be interpreted only in conjunction with the appended claims.

What is claimed is:

1. A spill-resistant container, comprising;

a cup, comprising:

a cap-engaging portion adjacent a lip surrounding an opening;

an inwardly projecting ledge adjacent the cap-engaging portion and having a plurality of spaced apart recesses;

a cap, comprising:

an annular sidewall having a cup-engaging portion adapted to engage the cap-engaging portion of the cup;

a cover portion closing a lower end of the annular sidewall to cover the opening of the cup such that the annular sidewall and the cover portion together form a reservoir of the cap;

a plurality of spaced apart openings extending through the reservoir, wherein each of the openings corresponds to a different one of the recesses in the ledge of the cup; and a lip and a skirt extending downward from the lip, the skirt having a bottom edge comprising a plurality of structures indicating positions of the spaced apart openings of the cap.

2. The spill-resistant container as recited in claim 1, wherein the structures of the bottom edge of the skirt of the cap indicating positions of the spaced apart openings of the cap comprise waves.

3. The spill-resistant container as recited in claim 2, wherein the waves of the bottom edge of the skid of the cap have downward extending portions that correspond to the positions of the spaced apart openings of the cap.

4. The spill-resistant container as recited in claim 1, wherein the cup further comprises a portion adjacent the lip comprising a plurality of structures indicating positions of the spaced apart recesses in the inwardly projecting ledge of the cup.

5. The spill-resistant container as recited in claim 4, wherein the structures of the portion of the cup adjacent the lip indicating positions of the spaced apart recesses in the inwardly projecting ledge of the cup comprise waves.

6. The spill-resistant container as recited in claim 5, wherein the waves of the portion of the cup adjacent the lip have downward extending portions that correspond to the positions of the spaced apart recesses in the inwardly projecting ledge of the cup.

7. The spill-resistant container as recited in claim 4, wherein when the structures of the bottom edge of the skirt of the cap are aligned with the structures of the portion of the cup adjacent to the lip, the spaced apart openings of the cap are aligned with the spaced apart recesses in the inwardly projecting ledge of the lodge of the cup.

8. The spill-resistant container as recited in claim 4, wherein when the structures of the bottom edge of the skirt of the cap are aligned with the structures of the portion of the cup adjacent to the lip, the spill-resistant container is in an open position such that when the cup is tilted, a liquid stored in a chamber of the cup may flow into the reservoir of the cap.

9. A spill-resistant container, comprising:

a cup, comprising:

a cap-engaging portion adjacent a lip surrounding an opening;

an inwardly projecting ledge adjacent the cap-engaging portion and having a plurality of spaced apart recesses;

a cap, comprising:

an annular sidewall having a cup-engaging portion adapted to engage the cap-engaging portion of the cup;

a cover portion closing a lower end of the annular sidewall to cover the opening of the cup;

a spout extending upwardly from the cover portion adjacent the sidewall at one side of the cap and having a duct extending therethrough;

a vent opening extending through the cover portion at a side of the can opposite the spout;

a lip and a skirt extending downward from the lip, the skirt having a bottom edge comprising a plurality of structures indicating positions of the spout and the vent opening of the cap; and wherein in an open position of the spill-proof container, the duct of the spout is aligned with one of the recesses in the ledge of the cup, and the vent opening is aligned with another one of the recesses in the ledge of the cup.

10. The spill-resistant container as recited in claim 9, wherein the structures of the bottom edge of the skirt of the cap indicating positions of the spout and the vent opening of the cap comprise waves.

11. A spill-resistant container, comprising:

a cup, comprising:

a cap-engaging portion adjacent a lip surrounding an opening;

an inwardly projecting ledge adjacent the cap-engaging portion and having a plurality of spaced apart recesses;

a portion adjacent the lip comprising a plurality of structures indicating positions of the spaced apart recesses in the inwardly projecting ledge of the cup;

a cap, comprising:

an annular sidewall having a cup-engaging portion adapted to engage the cap-engaging portion of the cup;

a cover portion closing a lower end of the annular sidewall to cover the opening of the cup;

a spout extending upwardly from the cover portion adjacent the sidewall at one side of the cap and having a duct extending therethrough;

a vent opening extending through the cover portion at a side of the cap opposite the spout; and wherein in an open position of the spill-proof container, the duct of the spout is aligned with one of the recesses in the ledge of the cup, and the vent opening is aligned with another one of the recesses in the ledge of the cup.

* * * * *